United States Patent [19]

Fraser

[11] Patent Number: 4,749,367

[45] Date of Patent: Jun. 7, 1988

[54] VULCAN TAP

[76] Inventor: Ward M. Fraser, P.O. Box 217, Harbor City, Calif. 90710

[21] Appl. No.: 53,018

[22] Filed: May 22, 1987

[51] Int. Cl.[4] ..... H01R 4/24

[52] U.S. Cl. ..... 439/417; 439/425; 439/687; 439/701; 439/731

[58] Field of Search ..... 439/391, 393, 396, 400, 439/406, 407, 417, 418, 425, 426, 435, 736, 696, 701, 711, 712, 714, 722, 731, 738, 750, 752, 638, 650, 651, 654, 655, 660, 686, 687

[56] References Cited

U.S. PATENT DOCUMENTS

| | | | |
|---|---|---|---|
| 3,594,681 | 7/1971 | Weiss | 439/736 |
| 3,602,872 | 8/1971 | Braunstein | 439/425 |
| 3,971,616 | 7/1976 | Hashimoto | 439/396 |
| 4,159,157 | 6/1979 | Koehler | 439/736 |
| 4,270,830 | 6/1981 | Brenner | 439/425 |
| 4,354,719 | 10/1982 | Weidler | 439/687 |
| 4,504,104 | 3/1985 | Leong et al. | 439/391 |
| 4,648,675 | 3/1987 | Gaines | 439/731 |

*Primary Examiner*—Gil Weidenfeld
*Assistant Examiner*—David Pirlot
*Attorney, Agent, or Firm*—Roger A. Marrs

[57] ABSTRACT

A connector is disclosed herein tapping into a power line at a selected location along its length which includes a pair of molded plastic pieces adapted to be snap-locked together in the shape of a "T". A pair of pronged metal conductors are embedded in the plastic pieces so that one portion extends into a central bore intended to receive the power line while another or second portion extends into a socket bore transverse to the central bore intended to insertably receive the prongs of a utility plug.

2 Claims, 1 Drawing Sheet

VULCAN TAP

BACKGROUND OF THE INVENTION

Field of the Invention

This invention relates to an electrical accessory for tapping into a power cord with a socket providing an additional electrical outlet.

Often, multiple electrical outlets are convenient along the length of a power cable or cord. However, it is difficult to break, cut or open gaps through the insulation to expose the power conductors with safety and assurance of a proper mechanical and electrical coupling with the power conductors Therefore, a long standing need exists to provide a supplemental or accessory connector capable of being snapped onto a power cable or cord which includes a socket for receiving a conventional power plug.

BRIEF DESCRIPTION OF THE DRAWINGS

The features of the present invention which are believed to be novel are set forth with particularity in the appended claims. The present invention, both as to its organization and manner of operation, together with further objects and advantages thereof, may best be understood with reference to the following description, taken in connection with the accompanying drawings in which:

DESCRIPTION OF THE PREFERRED EMBODIMENT

Figure 1:
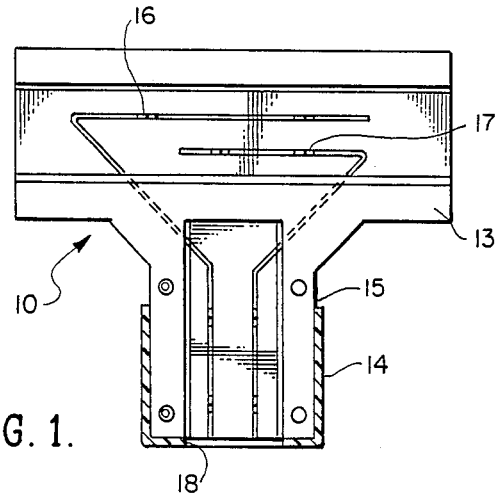
FIG. 1 is an exploded perspective view of the novel power tap.
Figure 3:
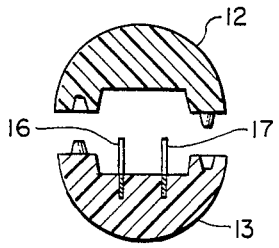
FIG. 3 is a top plan view.
Figure 2:
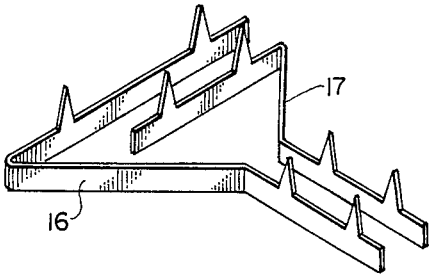
FIG. 2 is a cross-sectional view of the power tap.
Figure 4:
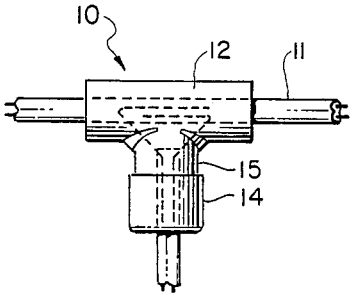
FIG. 4 is a cross-sectional view.
Figure 5:
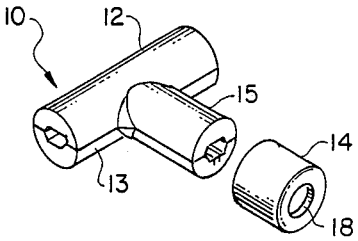

The power tap 10 is a means of attaching an electrical branch to an electric cord 11. It is more secure than a splice and saves considerable time. It is practical because it eliminates use of tape, solder, or peeling of insulation.

It is made in the shape of a "T". Two matching plastic pieces 12 and 13 are held together by a thimble 14, which fits over the leg 15 of the "T". Two pronged, metal strips 16 and 17 are embedded in one of the plastic pieces such as piece 13.

When the power tap is in use, a splice cord comes off the primary cord. The prongs 16 and 17 pierce the insulation in the cross of the "T" and the leg of the "T".

The splice cord feeds through a hole 18 in the end of the thimble. When all wires are in place, the other half of the shell is pushed into position and the thimble slipped into place to hold the assembly together.

The device is designed for use inside an appliance, or other piece of electrical equipment, where it is protected from pulls, damage, or other mishandling.

While particular embodiments of the present invention have been shown and described, it will be obvious to those skilled in the art that changes and modifications may be made without departing from this invention in its broader aspects and, therefore, the aim in the appended claims is to cover all such changes and modifications as fall within the true spirit and scope of this invention.

What is claimed is:

1. A power tap for use with a conventional power line having parallel electrical conductors, the combination comprising:

a pair of "T" shaped molded pieces snap-locked together to define a integral body;

each of said pieces having a channel combining to define an open-ended "T" shape passageway having an elongated central passageway and a transverse passageway separated from said central passageway;

a pair of electrical conductors embedded in said pieces which include prongs and exposed portions residing in each of said central and transverse passageways; and a sleeve slidable over a section of said pieces to releasably secure said pieces together.

2. The invention as defined in claim 1 wherein:

said power line occupies said central passageway and exposed conductors in said transverse passageway are adapted to insertably receive a conventional plug.

* * * * *